US006832924B2

(12) United States Patent
Maletzki et al.

(10) Patent No.: US 6,832,924 B2
(45) Date of Patent: Dec. 21, 2004

(54) PRESSURE COMPENSATED PLUG CONNECTOR

(75) Inventors: Manfred Maletzki, Eckernforde (DE); Oliver Hirsch, Kiel (DE)

(73) Assignee: Gisma Steckverbinder GmbH, Neumunster (DE)

( * ) Notice: Subject to any disclaimer, the term of this patent is extended or adjusted under 35 U.S.C. 154(b) by 0 days.

(21) Appl. No.: 10/276,852

(22) PCT Filed: May 18, 2001

(86) PCT No.: PCT/DE01/01921

§ 371 (c)(1),
(2), (4) Date: Feb. 11, 2003

(87) PCT Pub. No.: WO01/91244

PCT Pub. Date: Nov. 29, 2001

(65) Prior Publication Data

US 2003/0181086 A1 Sep. 25, 2003

(30) Foreign Application Priority Data

May 20, 2000 (DE) ..... 100 25 140

(51) Int. Cl.[7] ..... H01R 4/60
(52) U.S. Cl. ..... 439/201; 439/205
(58) Field of Search ..... 439/201, 205, 439/206, 199

(56) References Cited

U.S. PATENT DOCUMENTS

| | | | | |
|---|---|---|---|---|
| 3,729,699 | A | 4/1973 | Briggs et al. | 439/199 |
| 4,142,770 | A | 3/1979 | Butler, Jr. et al. | |
| 4,192,569 | A | 3/1980 | Mucci | 439/201 |
| 4,373,767 | A | 2/1983 | Cairns | 439/199 |
| 4,390,299 | A | 6/1983 | Mutschler | |
| 4,606,603 | A | 8/1986 | Cairns | 439/206 |
| 4,795,359 | A | 1/1989 | Alcock et al. | 439/201 |
| 4,948,377 | A | 8/1990 | Cairns | 439/201 |
| 5,203,805 | A | 4/1993 | Cairns | 439/199 |

FOREIGN PATENT DOCUMENTS

EP 0251655 B1 1/1988

*Primary Examiner*—Renee Luebke
(74) *Attorney, Agent, or Firm*—Larson & Larson, PA; Herbert W. Larson

(57) ABSTRACT

A pressure compensated plug connector is provided for making an electrical connection under water. The connector includes a plug part provided with contact pins, a socket part having a casing for receiving a plurality of female contacts. A front plate is also included in the connector having a number of openings which correspond to the number of female contacts employed therein. The casing has at least one pressure compensating bore for compensating pressure between an inner space of the casing and the surrounding environment. A membrane separates an outer space communicating with the pressure compensating bore from an inner space filled with a non-conductive fluid surrounding the female contacts. The female contacts include a sealing sleeve adjacent to the opening, a front contact support, a sliding piston, a spring for applying force to the sliding piston, an outlet valve located between the sealing sleeve and the front contact support which connects the space occupied by the sliding piston in the unplugged state and opens to the inner space when the contact pin is inserted into the female contact, and an inlet valve located in the rear of the female contact which allows for the flow of fluid into the female contact when the contact pin is pulled out.

4 Claims, 3 Drawing Sheets

PRESSURE COMPENSATED PLUG CONNECTOR

PRIOR APPLICATIONS

This application bases priority on International Application No. PCT/DE01/01921, filed May 18, 2001, which in turn bases priority on German Application No. DE 100 25 140.4, filed May 20, 2000.

BACKGROUND OF THE INVENTION

1. Field of the Invention

The invention relates to a pressure compensated plug connector for use under water.

2. Description of the Prior Art

Electrical connectors, such as are known from U.S. Pat. No. 5,203,805, to Cairns, are particularly used in producing an electrical connection under water. A similar connector is known from EP 251655 A1.

In the case of such connectors which have to be plugged in under water, the problem arises that upon plugging in water, film adhering to the contact pin is introduced into the socket part.

The problem of the invention is to provide a connector of the aforementioned type where a reduction in the insulation resistance by introduced water or contaminants is essentially eliminated.

SUMMARY OF THE INVENTION

The basic idea of the invention is to design the connector in such a way that on plugging in there is a flushing of the contact pin and insulation zone, and the contaminants introduced in spite of the seal are removed. The moving up of fresh oil into the insulation zone provides a reliable insulation, even after multiple plugging has taken place.

DESCRIPTION OF THE DRAWINGS

Further advantages and features of the invention can be gathered from the following description of a preferred embodiment of the invention with reference to the attached drawings, wherein.

DETAILED DESCRIPTION OF THE PREFERRED EMBODIMENT

Figure 1:
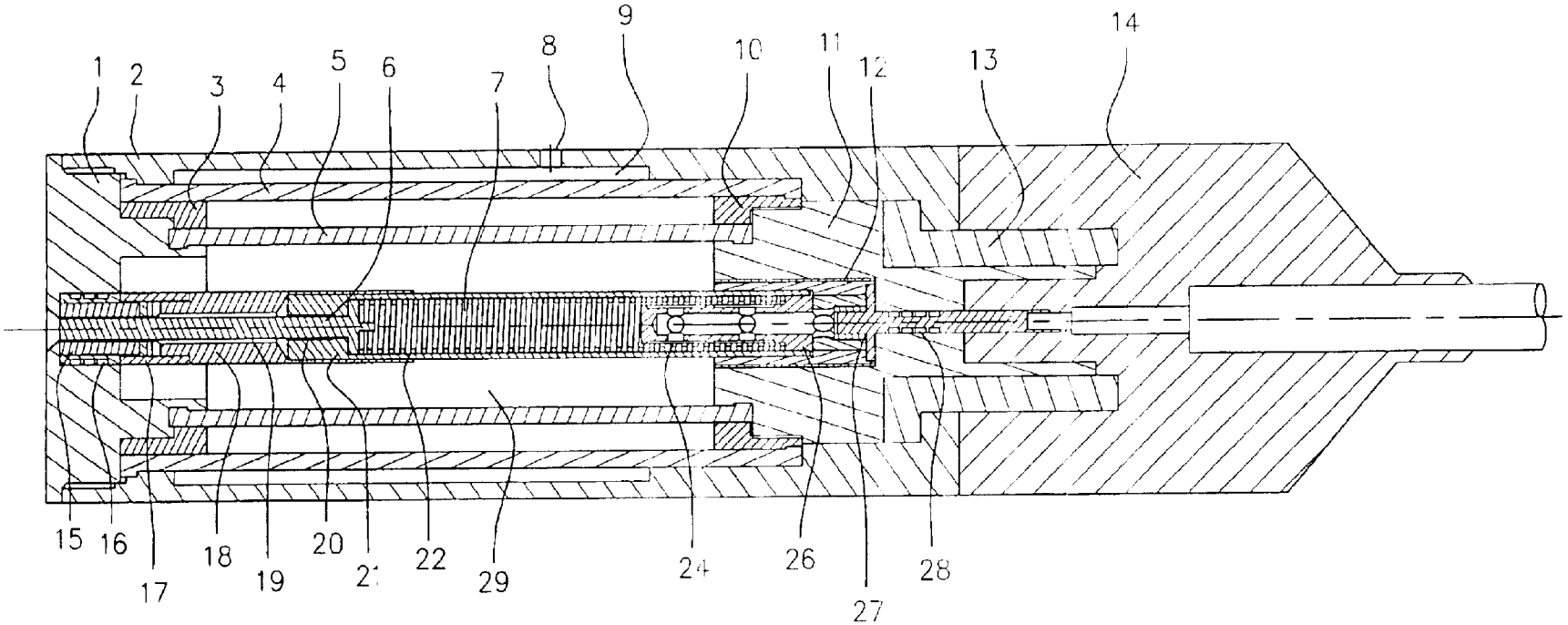
FIG. 1 shows a sectional representation of the pressure compensated plug connector through a socket part of said connector.

The socket part of an electrical connecter shown in FIG. 1 has a casing 2, whose end face is closed by a front plate 1. In the casing 2 is located a female contact 7 (in practice several such female contacts are provided), which is aligned with an opening in the plate 1, and which serves to introduce a contact pin 30 (see FIG. 3) of the associated plug part (of which is not shown). An inner space 29 is formed around the female contact 7, and is filled with a non-conducting fluid, particularly an oil. Two diaphragms 5 and 4, which are retained by a front diaphragm fastening ring 3 and rear diaphragm fastening ring 10, and between which a gap is formed, are connected to the outside. Between the casing 2 and the outer diaphragm 4, is formed an outer space 9 which communicates with the surrounding water via a pressure compensating bore 8. The portion of the socket part remote from the plate 1 is formed by a rear contact receptacle 11, a sealing receptacle 13, and a seal 14.

The female contact 7, whereof only one is visible in the embodiment shown in FIG. 1, but where in practice several are provided, is constructed in the form of a cylindrical sleeve. It comprises a sealing sleeve 15, which is constructed with an O-ring contour, O-ring seals 16, an outlet valve 17, a front contact receptacle 18, a front contact support 21 on which a socket contact lamella 20 is formed, an inlet valve 24 which is located in the rear area of the female contact 7, a rear contact support 26, a solder contact 27, and a cable strand 28.

Figure 2:
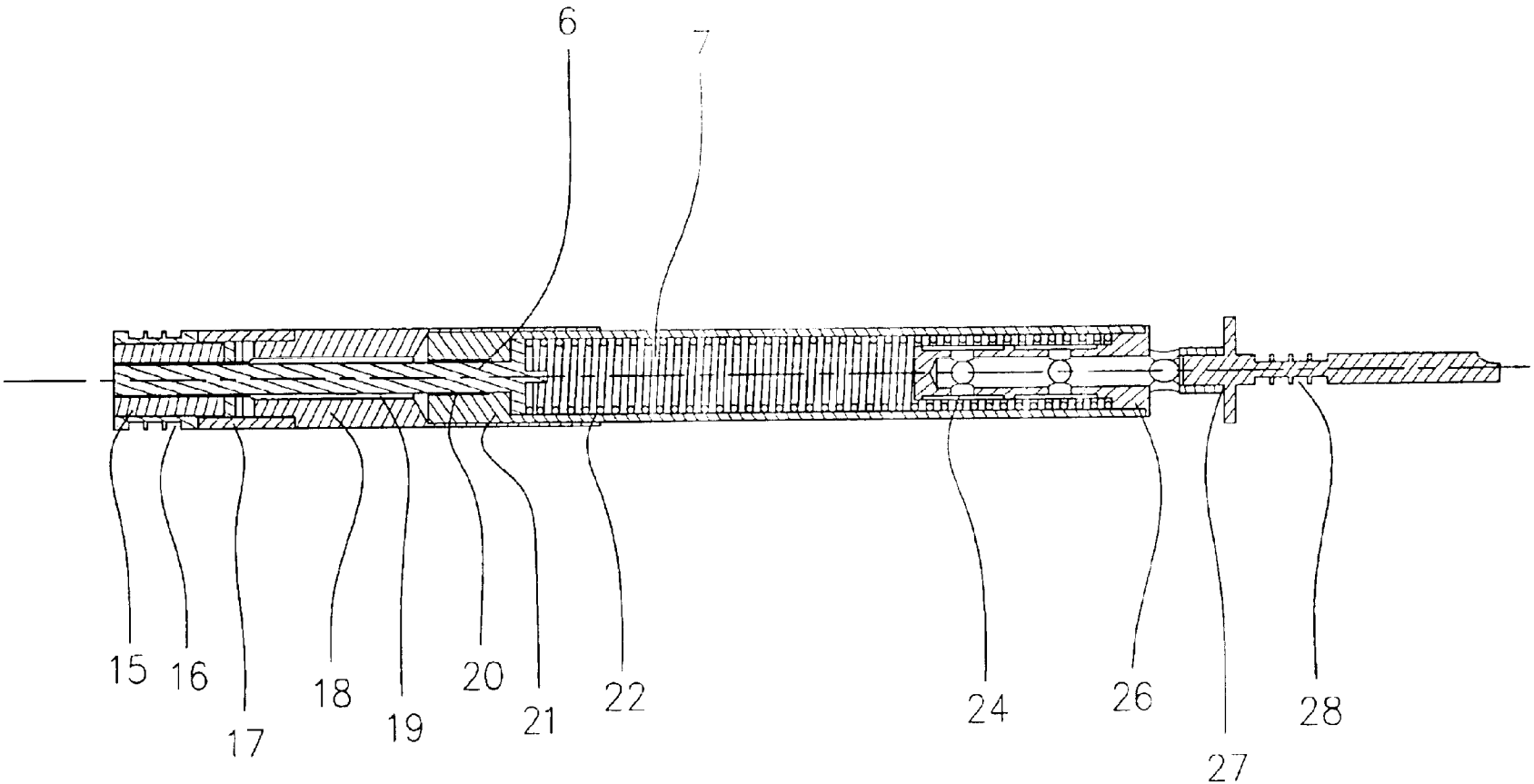
FIG. 2 shows an isolated view of the female contact.
Figure 3:
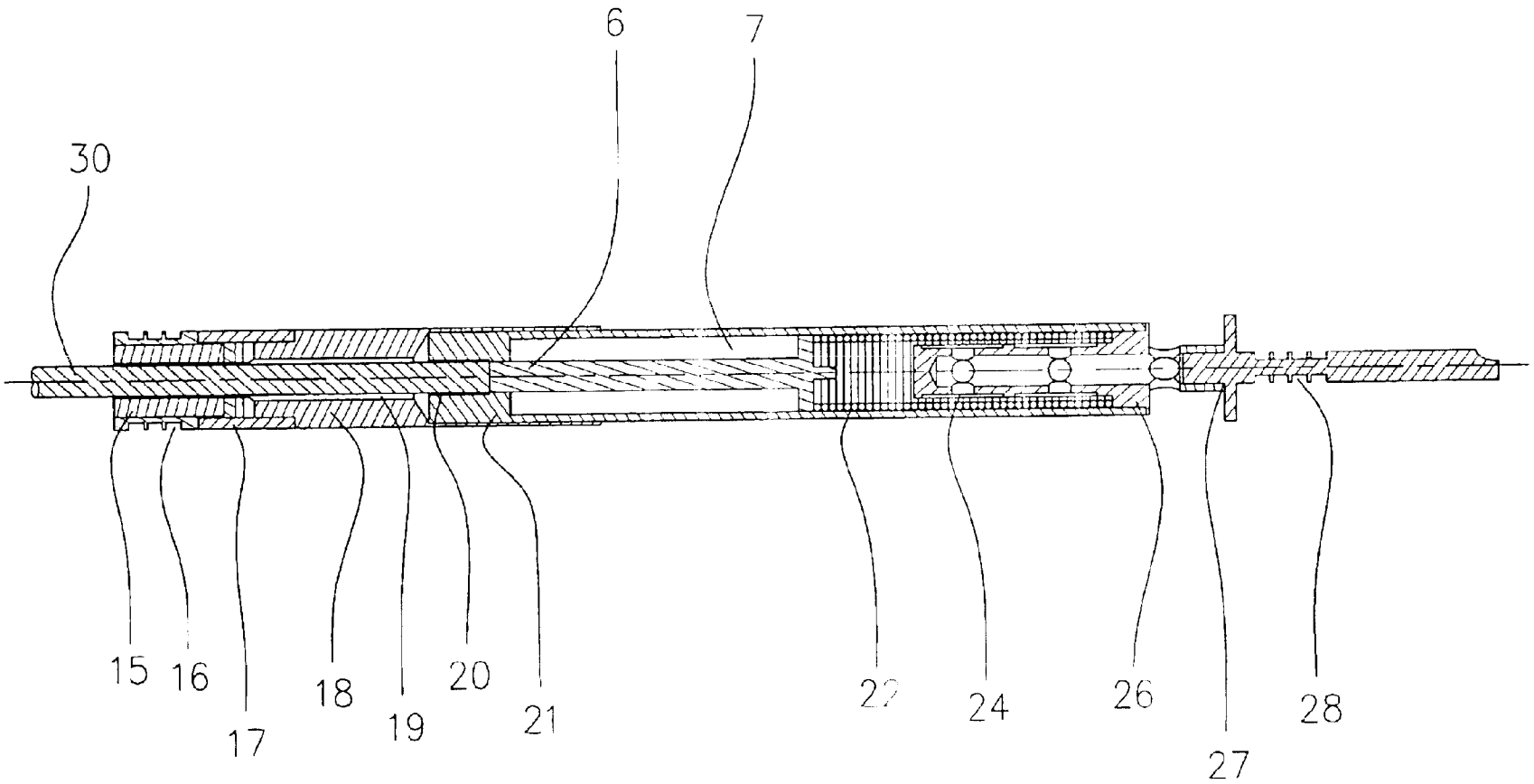
FIG. 3 shows the female contact of FIG. 2 wherein a contact pin is inserted into the female contact.

A compression spring 22 is inserted in the female contact 7 and acts on a sliding piston 6, which in the cylindrical inner space formed by the sealing sleeve 15, the front contact receptacle 18, and the front contact support 21, is displaceably arranged between the position shown in FIG. 2 and that shown in FIG. 3.

The internal diameter of the sealing sleeve 15 corresponds to the diameter of the sliding piston 6 and the contact pin 30 diameter of the plug part of the connector coinciding therewith. The internal diameter of the front contact receptacle 18 is larger than the diameter of the sliding piston 6 so that an annular space 19 is formed between the shaft of the sliding piston 6 and the front contact receptacle 18.

If for producing a connection a contact pin 30 of the plug part is engaged on the opening in the front plate 1, a front face engaging with the outwardly directed end face of the sliding piston 6 wherein the contact pin 30 is then pressed into the female contact 7, the sliding piston 6 enters the space of the female contact 7 followed by the contact pin 30. The sliding piston 6 displaces oil from the oil-filled space of the female contact 7, which flows past the annular space 19 at the sliding piston shaft counter to the piston movement direction. During this process, the oil in the socket contact area is replaced and contaminants are flushed through the valve 17 into the space 29.

When the front end of the contact pin 30 has passed the sealing sleeve 15, the oil displaced by the sliding piston 6 from the space of the female contact 7 flows along the contact pin 30 and an insulation zone so that the water film (or a contaminant), resting on the contact pin 30 and insulation zone, is flushed away by the oil. The oil, carrying with it the water stripped off from the contact pin 30 in the inner space 29 surrounding the female contact 7, passes through the valve 17 and out of said contact 7. This reliably ensures that water does not enter the vicinity of the socket contact lamella 20 or in the insulation zone, and does not lead to an electric short-circuit with the surrounding sea water.

The diaphragm 5 is designed in such a way that the inner space 29 can receive an additional fluid quantity corresponding to the volume of the contact pin 30 penetrating the female contact 7.

On releasing the connection, i.e. on extracting the contact pin 30, the compression spring 22 forces the sliding piston 6 back into the position shown in FIG. 2. During this process, the valve 24 opens so that oil from the inner space 29 flows through a filter 12 into the space of the female contact 7. Filter 12 acts as a separating system between inner space 29 and inlet valve 24.

In addition to the fluid, the inner space 29 can receive a hydrophilic material which holds back water that has entered the inner space 29, even after numerous plugging processes prevent the reentry of water into the space of the female contact 7. The sliding piston 6 can be provided with a circumferential ring groove which transports the oil out of the annular space 19.

What is claimed is:

1. An improved pressure compensated electrical plug connector having a socket part for receiving at least one contact pin of a plug part, the socket part including a casing having at least one female contact and a front plate mounted to the casing, the front plate having at least one opening formed therein in axial alignment with the at least one female contact, a number of the at least one contact pin corresponding to a number of the at least one opening and the at least one female contact, each at least one contact pin inserting through each at least one opening in the front plate and into each at least one female contact, the casing having at least one pressure compensating bore for compensating a pressure between an inner space of the casing and an environment in which the plug connector is located, the casing further having a membrane separating the inner space from an outer space, the outer space communicating with the at least one pressure compensating bore, the inner space filled with a non-conducting fluid and surrounding the at least one female contact, the at least one female contact having a sealing sleeve and a front contact support, the at least one female contact enclosing a sliding piston displaceable within a space defined by the at least one female contact, a diameter of the at least one female contact corresponding to a diameter of the at least one contact pin, the improved pressure compensated electrical plug connector further having a spring mounted within the space defined by the at least one female contact for moving the sliding piston in a direction towards the at least one opening when the spring is in a non-compressed state, the improvement comprising:

a) an outlet valve positioned intermediate the sealing sleeve and the front contact support for closing off the space defined by the at least one female contact from the inner space filled with the non-conductive fluid when the improved pressure compensated electrical plug connector is in an unplugged state;

b) the outlet valve opening the space defined by the at least one female contact to the inner space filled with the non-conductive fluid when the improved pressure compensated electrical plug connector is receiving the at least one contact pin;

c) an inlet valve positioned in a distal area of the at least one female contact providing an opening to the inner space filled with the non-conductive fluid from the space defined by the at least one female contact when extracting the at least one contact pin from the at least one female contact thereby allowing an afterflow of fluid into the space defined by the at least one female contact; and d) a separating system located intermediate the inner space of the casing and the inlet valve.

2. The improved pressure compensated electrical plug connector of claim 1, wherein the at least one female contact is provided with an O-ring seal positioned between the outlet valve and the front plate.

3. The improved pressure compensated electrical plug connector of claim 1, wherein the separating system is a filter.

4. The improved pressure compensated electrical plug connector of claim 1, wherein a hydrophilic material is introduced into the inner space for purposes of holding back water as it is introduced into the inner space.

* * * * *